US005996664A

United States Patent [19]

Gregoire

[11] Patent Number: 5,996,664

[45] Date of Patent: Dec. 7, 1999

[54] COMPACT MAIL-PROCESSING MACHINE HAVING A SPECIAL TRANSPORT PATH

[75] Inventor: Jean-Pierre Gregoire, Brie Comte Robert, France

[73] Assignee: Neopost Industrie, Bagneux, France

[21] Appl. No.: 09/012,188

[22] Filed: Jan. 23, 1998

[30] Foreign Application Priority Data

Jan. 24, 1997 [FR] France ..... 97 00760

[51] Int. Cl.[6] ..... B41F 17/00; B41F 19/00; B65H 5/00

[52] U.S. Cl. ..... 156/350; 156/384; 156/566; 156/570; 101/44; 271/264; 705/406

[58] Field of Search ..... 156/277, 384, 156/566, 570, 571, 572, 541, 542, 442, 442.2; 177/25.15, 145; 705/406; 198/463.3, 606, 607; 271/264; 101/44, 71

[56] References Cited

U.S. PATENT DOCUMENTS

| | | | |
|---|---|---|---|
| 2,302,060 | 11/1942 | Ryan | 156/442 X |
| 3,688,112 | 8/1972 | Morley et al. | 156/384 X |
| 3,721,601 | 3/1973 | Pituch et al. | 156/542 |
| 3,741,085 | 6/1973 | Sutton | 156/552 |
| 4,183,779 | 1/1980 | Barber et al. | 156/384 X |
| 4,460,428 | 7/1984 | Teraoka | 156/384 X |
| 5,133,396 | 7/1992 | Selak et al | 156/542 X |
| 5,163,669 | 11/1992 | Hurd et al. | 271/125 |
| 5,200,007 | 4/1993 | Svyatsky | 156/542 X |
| 5,618,375 | 4/1997 | Suzuki et al. | 156/442.2 X |
| 5,723,825 | 3/1998 | Dolan et al. | 177/145 |
| 5,730,275 | 3/1998 | Hansen | 198/460.3 |
| 5,767,452 | 6/1998 | Yankloski | 177/145 X |

FOREIGN PATENT DOCUMENTS

| | | |
|---|---|---|
| 2 195 312 | 4/1988 | United Kingdom . |
| 2 212 483 | 7/1989 | United Kingdom . |
| 2 213 804 | 8/1989 | United Kingdom . |

*Primary Examiner*—Richard Crispino
*Assistant Examiner*—Sue A. Purvis
*Attorney, Agent, or Firm*—Sughrue, Mion, Zinn, Macpeak & Seas, PLLC

[57] ABSTRACT

A mail processing machine including a base, a mail item feed station and a station for storing said items after processing in the base, said base including a printhead adapted to print postage imprints on mail items from a magazine of the feed station and conveyor rollers for transporting said items along a transport path of said base to a magazine of the storage station, control means, display means and processing means being additionally provided for controlling said machine, and the transport path of the base of the machine is inclined at a particular angle to the horizontal, in the range a few degrees, preferably 10°, to a few tens of degrees, preferably 30°.

5 Claims, 2 Drawing Sheets

COMPACT MAIL-PROCESSING MACHINE HAVING A SPECIAL TRANSPORT PATH

FIELD OF THE INVENTION

The present invention concerns the exclusive field of mail processing. It is more particularly concerned with a postage meter or "franking machine" that can process stacks of large-size mail items within a small volume.

PRIOR ART

At present, conventional machines, some of which are modular to some degree, have feed and storage systems of variable height. In particular, machines that have to frank a large number of mail items, and consequently have high feed and storage capacities and high throughputs, generally have an overall length that is necessarily great. These high storage capacities presuppose a particular overall height and/or length at the entry and exit of the machine, which degrades the general ergonomics of the machine and limits its ease of use. This applies even more in designs incorporating a label dispenser of very large diameter, which imposes a relatively complex machine structure. European application EP 0 718 799 illustrates perfectly the problem posed by integrating a label dispenser into a conventional type franking machine.

OBJECT AND DEFINITION OF THE INVENTION

The object of the present invention is a mail processing machine for processing a large capacity of mail items whilst having a particularly small overall size compared to prior art machines. One aim of the invention is additionally to integrate a label dispenser into this machine without increasing its overall size.

These aims are achieved by a mail processing machine including a base, a mail item feed station, and a station for storing said items after processing in the base, said base including a printhead adapted to print postage imprints on mail items from a magazine of the feed station and conveyor rollers for transporting said items along a transport path of said base to a magazine of the storage station, control means, display means, and processing means being additionally provided for controlling said machine, wherein said transport path of the base is inclined at a particular angle to the horizontal in the range a few degrees, preferably 10°, to a few tens of degrees, preferably 30°.

The inclination of the transport path optimizes the overall size of the processing machine for high stacks of mail.

The magazine of the mail item feed station can pivot about a hinge axis in order to impart to it a particular inclination to the horizontal. This inclination of the feed magazine is in the range 0° to a few tens of degrees, preferably 30°. The inclination of the feed magazine advantageously corresponds to that of the transport path of the base of the machine.

Because of the inclination of the transport path, the base of the machine can include a label dispenser disposed under and as close as possible to the printhead without this addition modifying the initial overall size of the base in any way. Furthermore, this considerably simplifies the path followed by the labels in the base.

BRIEF DESCRIPTION OF THE DRAWINGS

Other features and advantages of the present invention become more apparent from the following description given by way of non-limiting example with reference to the accompanying drawings, in which.

DETAILED DESCRIPTION OF A PREFERRED EMBODIMENT

Figure 2:
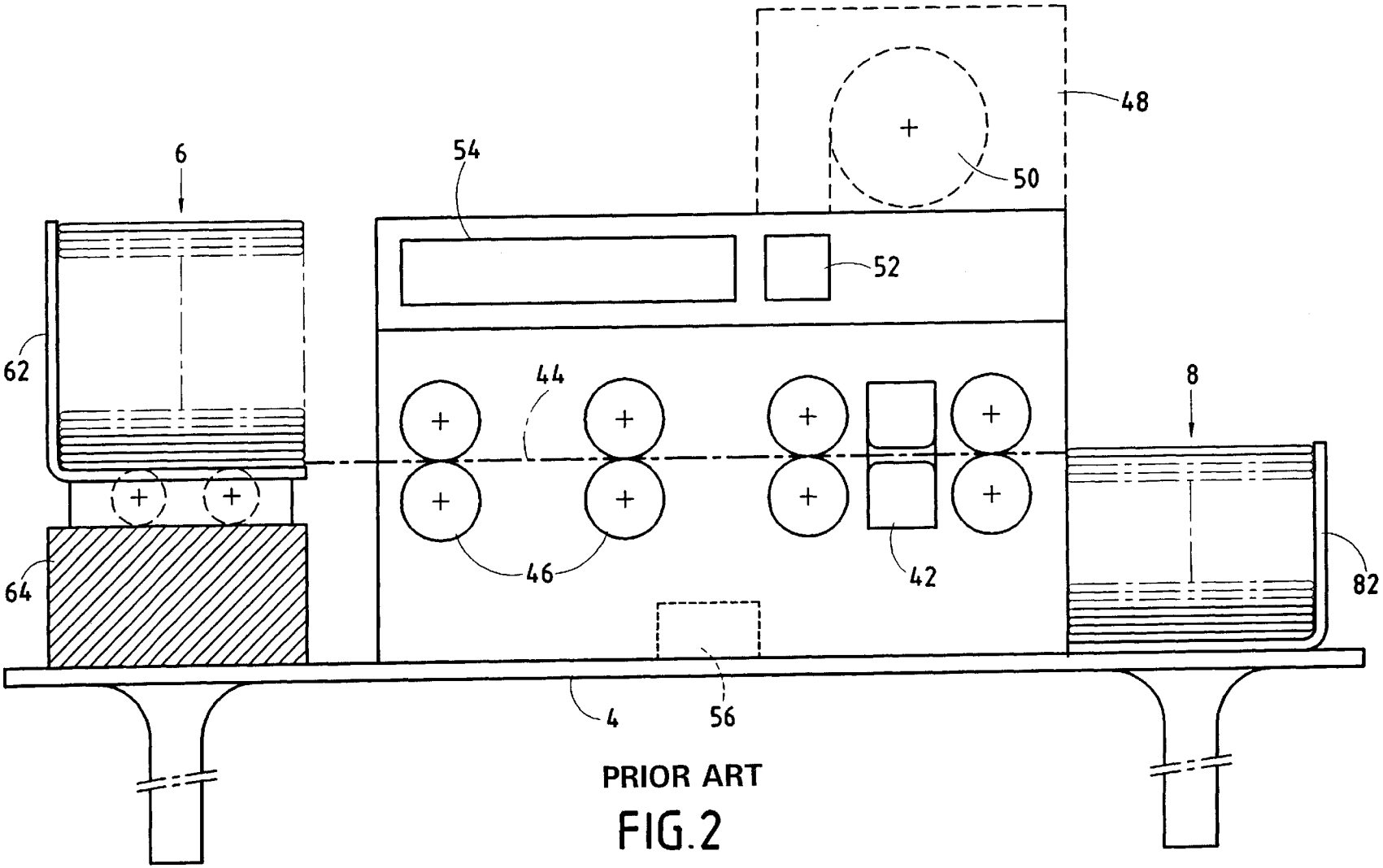
PRIOR ART FIG.2
FIG. 2 is an elevation view of a prior art franking machine.

Consider first FIG. 2 which shows a prior art franking machine. This comprises, on a worktable 2 at the height of the operator, a base 4 preceded by a mail item feed station 6 and followed by a station 8 for storing these items after processing. The base 4 of the franking machine conventionally includes a printhead 42 adapted to print postage imprints on mail items from a magazine 62 of the feed station 6. These items are conveyed along a transport path 44 of the base 4 of the machine by conveyor rollers 46, firstly towards the printhead 42 and then towards a magazine 82 of the storage station 8. A dispenser 48 of postal labels to each of which a postage imprint can be applied by the printhead and which includes a dispenser spool 50 is provided in the base of the franking machine, generally on its upper part or its rear part, given the particularly bulky nature of a dispenser of this kind (note that its external location makes the path of the labels complex and particularly sinuous). Of course, the base also includes a control keypad 52 and display means 54 adapted to co-operate with processing means, for example microprocessor-based processing means 56, to control the operation of the machine.

It is important to note that with this conventional structure, the storage capacity of the magazine 82 in the vertical position is limited by the height of the transport path 44 where it leaves the base of the franking machine. If this capacity has to be increased, the only feasible solution is to provide horizontal storage, but this can be done only to the detriment of the overall length of the machine. Note also, concerning the feeding of mail items, that the magazine 62 must necessarily be disposed on a base 64 so that its outlet orifice coincides with the entry of the base 4 of the franking machine, a consequence of which is that in practice the capacity of the magazine is limited.

Figure 1:
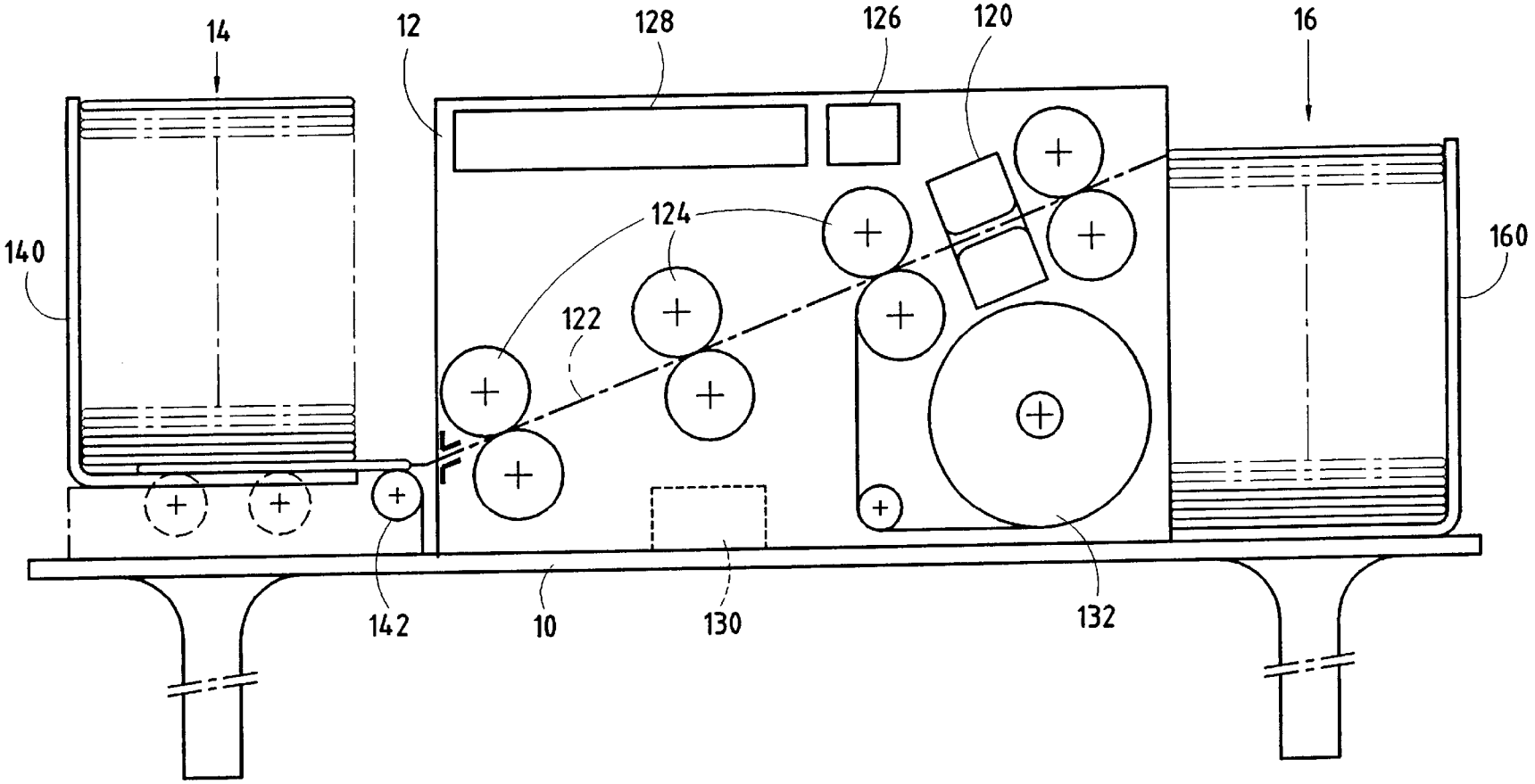
FIG. 1 shows a mail processing machine of the invention.

FIG. 1 is a schematic representation of a mail processing machine, or franking machine, of the invention which has an improved feed and storage capacity and which additionally eliminates the need for an external label dispenser.

As previously, this machine includes, on a worktable 10 at the height of the operator, a base 12 preceded by a mail item feed station 14 and followed by a station 16 for storing these items after processing. The base 12 of the franking machine conventionally includes a printhead 120 adapted to print postage imprints on mail items from a magazine 140 of the feed station 14. These items are conveyed along a transport path 122 of the base of the machine by conveyor rollers 124, firstly towards the printhead 120 and then towards a magazine 160 of the storage station 16. The base also includes a control keypad 126 and display means 128 adapted to co-operate with processing means, for example microprocessor-based processing means 130, to control the operation of the machine.

In accordance with the invention, the transport path 122 of the mail items is inclined to the horizontal at a particular acute angle in the range a few degrees (at least 10°) to a few tens of degrees (at most 30°) so that it is possible to accommodate a spool 132 of a postal label dispenser directly under the printhead 120 without having to modify the initial overall size of the machine. This also eliminates the particularly bulky nature of a dispenser of this kind. The inclination of the transport path limits the overall size of the machine whilst increasing its mail item feed and storage capacity. The feed magazine 140 can then be placed directly on the worktable 10 on which the base of the machine rests, so that there is no need to increase the total height of the machine despite the great height that the stack of mail items to be processed can then have. Moreover, the storage magazine 160 then has a higher entry orifice, which increases its capacity.

In an advantageous embodiment the feed magazine 140 can pivot about a hinge axis 142 to incline the stack of mail items that it contains. This inclination is preferably in the range 0° to a few tens of degrees, advantageously 30°, and can correspond to the inclination of the transport path.

This inclination, which can be different from the inclination of the transport path in the base:

facilitates unstacking of the letters to be routed;

folds the flap of an envelope onto its body;

adapts the feeding of the letters according to their format and thickness, for example by raising the magazine if the format is large or by lowering the magazine if the thickness is great.

What is claimed is:

1. A mail processing machine comprising:

a base;

a mail item feed station; and a station for storing said items after processing in the base, wherein said base includes a printhead adapted to print postage imprints on mail items from a magazine of the feed station and conveyor rollers for transporting said items along a transport path of said base to a magazine of the storage station, wherein control means, display means, and processing means are additionally provided for controlling said machine, and wherein said transport path of the base of the machine is inclined at a particular angle to the horizontal, in the range of approximately 10° to a approximately 30°.

2. A mail processing machine according to claim 1, wherein the magazine of the mail item feed station can pivot about a hinge axis to impart to it a particular inclination to the horizontal.

3. A mail processing machine according to claim 2, wherein the inclination of the feed magazine is in the range 0° to approximately 30°.

4. A mail processing machine according to claim 2, wherein the inclination of the feed magazine corresponds to that of the transport path of the base of the machine.

5. A mail processing machine according to claim 1, wherein the base of the machine further includes a label dispenser disposed under and as close as possible to the printhead so that the initial overall size of said base is not modified by this addition.

* * * * *